US005542217A

United States Patent [19]

Larivee, Jr.

[11] Patent Number: 5,542,217

[45] Date of Patent: Aug. 6, 1996

[54] MOLDED ONE-PIECE ENTRY DOOR FLASHING PAN

[76] Inventor: William V. Larivee, Jr., 1715 Creek St., Kill Devil Hills, N.C. 27948

[21] Appl. No.: 304,853

[22] Filed: Sep. 13, 1994

[51] Int. Cl.[6] ..... E06B 1/70

[52] U.S. Cl. ..... 49/471; 49/506

[58] Field of Search ..... 49/467, 468, 469, 49/470, 471, 506

[56] References Cited

U.S. PATENT DOCUMENTS

| | | | |
|---|---|---|---|
| Re. 25,590 | 6/1964 | Miller | 49/471 X |
| 385,065 | 6/1888 | Milroy | 49/471 |
| 448,501 | 3/1891 | Bussert | 49/471 |
| 665,958 | 1/1901 | Dugan | 49/467 X |
| 1,875,495 | 9/1932 | Reese | 49/469 |
| 2,129,381 | 9/1938 | Oftedal et al. . | |
| 3,851,420 | 12/1974 | Tibbetts | 49/471 |
| 3,854,246 | 12/1974 | McAllister | 49/470 |
| 4,055,917 | 11/1977 | Coller | 49/469 |
| 4,098,027 | 7/1978 | Crance | 49/468 X |
| 4,411,104 | 10/1983 | St. Aubin | 49/467 X |

FOREIGN PATENT DOCUMENTS

| | | | |
|---|---|---|---|
| 481303 | 12/1969 | Switzerland | 49/471 |

*Primary Examiner*—Philip C. Kannan

*Attorney, Agent, or Firm*—John G. Mills and Associates

[57] ABSTRACT

This invention is an integrally-formed entry door flashing pan that fits snugly in the threshold of a rough-entry door opening. The flashing pan has an upwardly projecting rear lip, upwardly projecting side lips, and a downwardly projecting exterior lip. The pan lies juxtaposed to the threshold subflooring with the side lips having felt building paper or other building wrap overlapping the same. The downwardly projecting exterior lip lies juxtaposed to the exterior of the building structure in which the rough entry door opening is formed. A entry door assembly can be placed on the flashing pan and secured to the sides and top of the rough opening without penetrating the watertight integrity of the flashing pan. The entry door is then trimmed out in the normal manner to provide an entry door flashing that is water proof and completely concealed when the building structure is completed.

10 Claims, 1 Drawing Sheet

MOLDED ONE-PIECE ENTRY DOOR FLASHING PAN

FIELD OF INVENTION

This invention relates to building structures and more particularly to flashing for entry doors.

BACKGROUND OF INVENTION

There has always been a problem with exterior doors and preventing moisture from being blown under and around exterior doors.

The above is particularly true where porches or other structures are lacking. Also, in open areas even with porches or other covering structure, rain can be driven almost horizontally against the entry door. This is particularly true in coastal areas where storms are quite often accompanied by very strong winds.

The result of water ingressing under the entry doors not only causes the adjacent interior floor to become wet, but over a period of time can cause the flooring to rot as well as the floor joist and door jamb. When this happens, very expensive repairs must be made. Once this is accomplished and a new door installed, the process starts all over with the floor becoming wet and rot setting in.

Specially extruded and molded thresholds with special weather seal systems have been devised in an effort to prevent the ingress of undesired water under and around entry doors. Even pan-like means have been suggested as a possible solution to the problem. Because of the details of these various means, none have proved to be successful in preventing strong, wind driven rain from being blown under the entry doors thus allowing the ingress of undesirable moisture into the interior of the structure.

CONCISE EXPLANATION OF REFERENCES

U.S. Pat. No. 448,501 to A. Bussert is considered of interest in that it discloses a threshold trough 8 composed of a metal plate and upwardly projecting flange extending from its sides and inner end as seen particularly clear in FIG. 4. The trough is held in place by nails or screws and the door sill has grooves in the same to allow water to escape. It should be noted in FIG. 2, however, that floor in 1 is solid under the door sill and trough so water could still seep back under the trough into the interior of the house.

U.S. Pat. No. 385,065 to T. K. Milroy discloses a weather strip made from cast iron. Again, the same is held in place by screws and the flooring on the inside and outside is solid which allows water to seep in.

U.S. Pat. No. 3,851,420 to Philip E. Tibbetts is considered of interest in that it discloses a relatively complicated extruded threshold that attempts to drain water away when blown against a door. Again, it is indicated that fasteners can be driven downwardly through the threshold into the underlying surface which would eventually cause leaks. Also, water can seep back under the threshold as with the earlier-described references.

U.S. Pat. Nos. 2,129,381 to M. S. Oftedal et al and 1,875,495 to F. Reese are both considered of interest in that they disclose a threshold with plates having lips thereon. Each of there references, however, are laid flat on the underlying floor so that water can still ingress thereunder from the exterior to the interior of the building.

U.S. Pat. No. 4,098,027 to James M. Crance is considered of interest in that it discloses a sliding door and sliding screen sill with a lip on one edge thereof. Again, the parts are riveted or screwed together which threatens the waterproof integrity. Also, the threshold is laid flat on the flooring which will allow water to seep between a threshold and such flooring.

Finally, U.S. Pat. Nos. Re. 25,590 to Wallace W. Miller and 4,055,917 to John Coller are both considered of interest in that they disclose threshold assemblies that are molded or extruded and include a front lip. Each of these thresholds are rather complicated and neither can be used with existing entry exterior doors and each are believed to leak in storm-driven rain conditions.

BRIEF DESCRIPTION OF INVENTION

After much research and study into the above-mentioned problems, the present invention has been developed to provide a means for protecting both the structure and the interior of a building from the ingress of water at the entry door, whether it be a hinged-type door or a sliding-type door. The present invention is completely hidden when in use and requires no modification to entry door assemblies. Also, there is no invasive securing means to compromise the watertight integrity of the present invention.

The above is accomplished through the provision of a molded one-piece entry door flashing pan with a bay portion that is placed in the rough door opening on the subflooring. An exterior lip is flush to the exterior of the threshold. Upwardly projecting side lips are covered with building felt or other wall sheeting on each end of the present invention. A shorter interior lip is provided that is adapted to butt against the interior flooring, whether it be wooden flooring, carpet, tile, or the like.

The door assembly, which includes the finished door frame, the door jamb and the door or doors, is simply placed on the flashing pan of the present invention and is installed by connectors in the sides and the header of the rough entry door opening. No invasive penetration of connectors is made through the flash pan of the present invention and, therefore, its watertight integrity is never compromised.

Once the door assembly, whether a single swinging door, swinging french doors or multiple sliding doors, is set in place on the pan of the present invention and secured to the rough opening in the building, the same can be trimmed out in the normal manner. The exterior wood threshold trim includes a plurality of vertical grooves to allow any water driven between the pan of the present invention and the door jamb of the door assembly to flow outwardly down the outer lip and harmlessly to the exterior of the building.

In view of the above, it is an object of the present invention to provide a one-piece entry door flashing pan that reins its watertight integrity when in use.

Another object of the present invention is to provide an entry door flashing pan that retains its watertight integrity when in use.

Another object of the present invention is to provide an entry door flashing pan that can be used with various types of prehung doors.

Another object of the present invention is to provide a waterproof flashing pan that is completely concealed when installation is complete.

Another object of the present invention is to provide an entry door flashing pan that is installed in rough entry door opening prior to the installation of the door, door frame and door trim.

Another object of the present invention is to provide a watertight molded one-piece entry door flashing pan that is impervious to water.

Another object of the present invention is to provide a one-piece entry door flashing pan that will not rot, rust, corrode, or otherwise deteriorate.

Other objects and advantages of the present invention will become apparent and obvious from a study of the following description and the accompanying drawings which are merely illustrative of such invention.

DETAILED DESCRIPTION OF INVENTION

The one-piece entry door flashing pan of the present invention, indicated generally at 10, is molded in a single piece and can be composed of any suitable material such as plastic or the like. Since the selection of materials of this type are well known to those skilled in the art, further detailed discussion of this portion of the same is not deemed necessary.

The entry door pan 10 of the present invention includes a relatively flat, rectangular-shaped bay portion 11 that is approximately the same length as various standard rough entry door openings and is approximately as wide as the door jamb of an entry door assembly.

An upwardly projecting interior lip 12 is integrally formed along the rear edge of bay portion 11. This lip is preferably three quarters of an inch high which is the normal thickness of interior flooring.

Upwardly projecting side or jamb lips 13 are integrally formed on the ends of the bay portion and the ends of interior lip 12. These side lips are preferably one and one half inches high.

Figure 1:
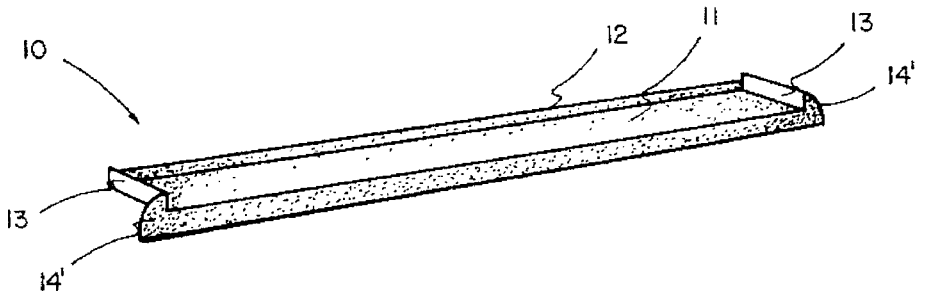
FIG. 1 is a front perspective view of the entry door flashing pan of the present invention.

A downwardly projecting exterior lip 14 is integrally formed along the front edge of bay portion 11. This exterior lip 14 extends outwardly beyond side or jamb lips 13, as indicated at 14', and then curves back to the top edge thereof so that such lip is integral with the front edge of the bay portion and the front end of the side lips as can clearly be seen in FIG. 1.

Figure 2:
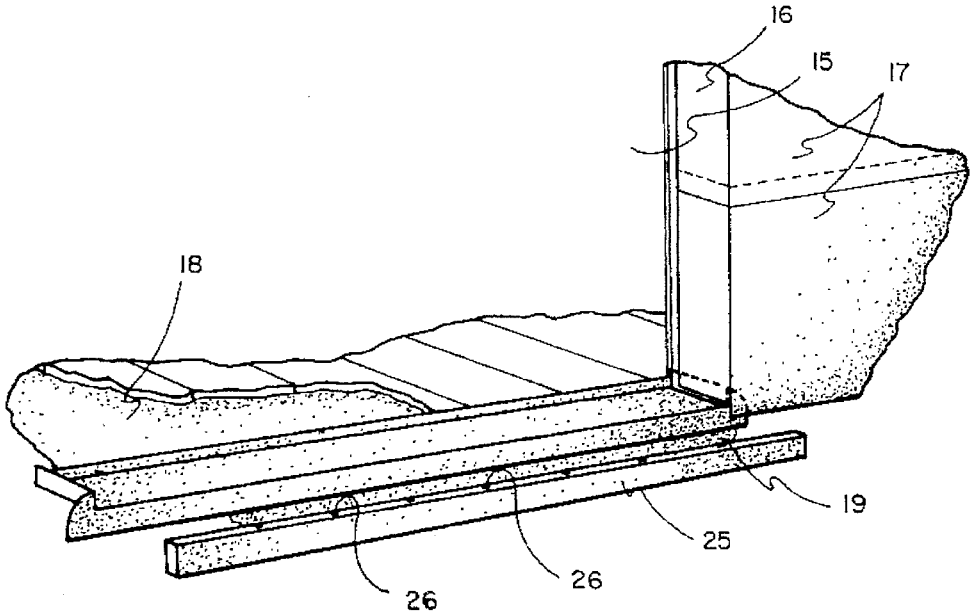
FIG. 2 is a perspective view of the flashing pan of the present invention installed in the rough entry door opening of a building structure.
Figure 3:
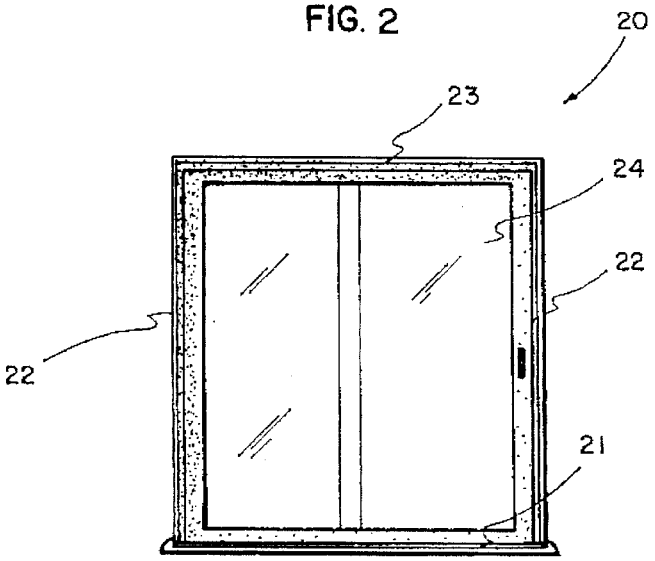
FIG. 3 is a front perspective view of an entry door assembly installed and trimmed out.

The rough entry door opening 15 is formed from a 2×4 jack stud 16 on either side thereof with felt or other building wrap material applied thereover and extending down into the flashing pan of the present invention over side lips 13 and exterior lip end portions 14' as can clearly be seen in FIG. 2.

The flashing pan 10 rests on the threshold rough opening 18 of the building structure with the downwardly projecting exterior lip 14 lying juxtaposed to the finished exterior sheathing veneer or the like 19.

The door assembly, indicated generally at 20, includes a threshold 21 connected to a pair of door jambs 22 which in turn are connected a header 23. The door or doors 24 are either hingedly connected to the door jamb or jambs, or track mounted if the assembly is for sliding doors such as sliding glass doors.

Entry door assemblies come in standard widths and the flashing pans of the present invention would also come in the same widths. Once the pan has been placed in the rough opening 15 as described above, the entry door assembly 20 is simply placed in the bay portion 11 of the one-piece entry door flashing pan 10 and is secured in such rough opening by a standard installation connector made into the jambs and header as the manufacturers of door assemblies specify. No connectors or fasteners are used to hold the threshold in place since it is connected to the lower portion of the door jambs.

Once the entry door assembly 20 is in place, the flashing pan 10 of the present invention cannot move inwardly because of the exterior lip 14, cannot move outwardly because of the interior lip 12 and cannot move sideways because the same lies juxtaposed to the jack studs 16.

Once the entry door assembly is in place, the same can be trimmed out in the normal manner. Finally, the threshold trim 25 is mounted on the outside of exterior lip 14 and is secured to the threshold 21 of the door assembly 20. A plurality of vertical grooves or slots 26 are provided in threshold trim 25 so water can escape harmlessly from the pan to the exterior of the building.

From the above it can be seen that the present invention provides a visually unseen means for preventing water from ingressing into the interior of a building under and around the entry door or doors. The watertight integrity is maintained by having the flashing pan integrally formed without openings therein.

The present invention is also simple to install and is highly efficient in accomplishing the desired results.

The present invention can, of course, be carried out in other specific ways than those herein set forth without departing from the spirit and essential characteristics of such invention. The present embodiments are, therefore, to be considered in all respects as illustrative and not restrictive, and all changes coming within the meaning and equivalency range of the appended claims are intended to be embraced therein.

What is claimed is:

1. Flashing for installation underneath entry doors comprising: a water impervious, flat, generally rectangular bay portion for installation in a rough entry door opening of a building structure underneath an entry door; an interior lip upwardly projecting at approximately 90 degrees integrally formed along one edge of said bay portion; side lips upwardly projecting at approximately 90 degrees integrally formed along opposite edges of said bay portion and on opposite ends of said interior lip; an exterior lip downwardly projecting at approximately 90 degrees integrally formed along the edge of said bay portion opposite said upwardly projecting interior lip and between said side lips, said exterior lip including lip end portions being integrally formed therewith and extending outwardly from each end thereof, said lip end portions also being integrally formed with an exterior edge of said lips in perpendicular relation thereto, whereby a waterproof entry door flashing is provided that extends underneath and completely surrounds a bottom surface of an entry door assembly preventing wind-blown water which penetrates through said entry door assembly from contacting the interior floor of said building structure.

2. The entry door flashing of claim 1 wherein said interior lip is approximately three quarters of an inch.

3. The entry door flashing of claim 1 wherein said upwardly projecting side lips are approximately one and a half inches high.

4. The entry door flashing of claim 1 wherein the exterior lip downwardly projects approximately one and one-half inches.

5. The entry door flashing of claim 1 wherein the bay portion, upwardly extending interior flange, the upwardly extending side flanges, and the downwardly extending front flange are all integrally formed.

6. The door flashing of claim 5 wherein said flashing pan is molded.

7. The method of installing a water impervious, integrally formed entry door flashing including a flat, generally rectangular bay portion having an interior edge, an exterior edge and side edges with an upwardly projecting lip at approximately 90 degrees along said interior edge, upwardly projecting lips at approximately 90 degrees along said end edges and a downwardly projecting lip at approximately 90 degrees along said exterior edge, comprising: forming a rough entry door opening having side jack studs, a header and a subflooring threshold with exterior sheathing therebelow in a building structure; placing said flashing pan in said rough entry door opening juxtaposed to said floor threshold, with said exterior lip juxtaposed to said exterior sheathing with said end lips being disposed juxtaposed to said jack studs; overlapping felt sheathing over said upwardly projecting end lips; placing a door assembly that includes a threshold connected to one end of a pair of door jambs with a header connected to the other end of said jambs with at least one door operatively mounted in said assembly, in said flashing pan; securing the door jambs and header in said rough opening; and trimming said entry door whereby a water impervious means is provided for flowing water that has penetrated around the vertical edges and underneath the threshold of said door assembly to the exterior of said building structure.

8. The method of claim 7 wherein said entry door assembly includes at least two doors.

9. The method of claim 7 wherein said entry door assembly includes at least one door.

10. The method of claim 7 wherein said entry door assembly is a sliding-type door.

* * * * *